US005781829A

United States Patent [19]

Wong et al.

[11] Patent Number: 5,781,829

[45] Date of Patent: Jul. 14, 1998

[54] LOW NOISE CHARGING SYSTEM

[75] Inventors: Chee-Chiu Joseph Wong, Fairport; Peter G. Fournia, Penfield, both of N.Y.

[73] Assignee: Xerox Corporation, Stamford, Conn.

[21] Appl. No.: 720,534

[22] Filed: Sep. 30, 1996

[51] Int. Cl.[6] ..... G03G 15/02

[52] U.S. Cl. ..... 399/91; 250/324; 250/326; 361/225; 399/170; 399/172; 399/311

[58] Field of Search ..... 399/91, 311, 170–173; 250/324–326; 361/220, 225, 230

[56] References Cited

U.S. PATENT DOCUMENTS 3,811,048 5/1974 Matsumoto et al. ..... 250/326
4,908,006 3/1990 Burysěk et al. ..... 474/117
4,908,007 3/1990 Henderson ..... 474/135
5,466,938 11/1995 Nakayama et al. ..... 250/326
5,539,501 7/1996 Yu et al. ..... 250/324 X

*Primary Examiner*—William J. Royer
*Attorney, Agent, or Firm*—William A. Henry, II

[57] ABSTRACT

A method and apparatus for achieving optimum noise control of multiple coronode wires in a copier/printer involves optimizing phase relationships of the voltage on the wires in such a way so as to steer the maximum part of the noise distribution profile in the direction best suited for absorption or dissipation. In a two corotron charging system, the coronodes are preferably charged to where the phase angle, charge frequency and spacing between wires are optimized. If desired, a sound absorption material could be added to the charging system.

22 Claims, 3 Drawing Sheets

LOW NOISE CHARGING SYSTEM

BACKGROUND OF THE INVENTION

This invention relates generally to the noise control in a copier or image output terminal (IOT), and more particularly concerns an improved noise control system utilizing an improved method and apparatus for providing optimum noise control in such apparatuses by steering the maximum noise into a predetermined location in space.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

The foregoing generally describes a typical black and white electrophotographic printing machine. With the advent of multicolor electrophotography, it is desirable to use an architecture which comprises a plurality of image forming stations. One example of the plural image forming station architecture utilizes an image on image system in which the photoreceptive member is recharged, reimaged and developed for each color separation. This charging, imaging, developing and recharging reimaging and developing is usually done in a single revolution of the photoreceptor as compared with multipass architectures which allow image on image to be achieved with a single charge, recharge system and imager, etc. This architecture offers a high potential for throughput and image quality.

Charging and recharging IOT systems require at least one charging station with attendant noise produced by those charging stations. Excessive noise from machines, such as, copier/printers in the working environment has been an irritant to others from the advent of such machines until the present day. One of the major contributors had been found to be the charging systems in the machines. Historically, noise from systems comes from the transformer and chock which can be controlled by an enclosure. However, in some systems noise is emitted from the wires of corona devices. The following disclosures may be relevant to various aspects of the present invention:

U.S. Pat. No. 4,908,006
Patentee: Buryseket al.
Issued: Mar. 13, 1990

U.S. Pat. No. 4,908,007
Patentee: Henderson
Issued: Mar. 13, 1990

The relevant portions of the foregoing disclosures may be briefly summarized as follows:

U.S. Pat. No. 4,908,006 discloses a belt tightening device for open-end spinning machines which is capable of ensuring good belt thrust, eliminating vibrations, and reducing the noise level of the machine. Each bearing box of a belt tightening roll is attached to the end of a pair of flat legs extending in spaced apart relationship to each other along the endless driving belt. The legs are connected to the bearing box either by sprint elements, or are formed themselves by leaf springs.

U.S. Pat. No. 4,908,007 is directed to a tensioner for a power transmission belt that is adapted to be operated in an endless path and a method of making the same. The tensioner includes a frictional dampening unit operatively associated with the belt tensioner to dampen the movement of a belt.

In accordance with one aspect of the present invention, there is provided a method of reducing noise from wires in a charging device. The method comprises steering the maximum noise in space to a predetermined location and then redistributing the sound field. As a consequence, the unwanted noise can be reflected back to the source and dissipated inside the machine.

Pursuant to another aspect of the present invention, there is provided an apparatus that controls acoustic noise generated from multiple wire discorotrons. The apparatus includes means for optimizing the phase relationships of the AC voltage on wires in such a way so as to steer the maximum part of the noise distribution profile in the direction best suited for absorption or dissipation. For additional noise reduction, absorption material is placed underneath the wires.

Yet another aspect of the present invention is to control noise by optimizing the spacing between charging wires.

Still yet another aspect of the invention is to control noise by optimizing the charge frequency.

Other features of the present invention will become apparent as the following description proceeds and upon reference to the drawings, in which.

This invention relates to a noise reduction scheme for an imaging system of the type which is used to produce an image on image color output in a single revolution or pass of a photoreceptor belt. It will be understood, however, that it is not intended to limit the invention to the embodiment disclosed. On the contrary, it is intended to cover all alternatives, modifications and equivalents as may be included within the spirit and scope of the invention as defined by the appended claims, including use in a multiple pass image on image color process system, and a single or multiple pass highlight color system.

Additionally, this invention relates to corona devices in general Corona devices are devices that ionize air for purposes of delivering ions to surfaces to be charged. It contains an element called a coronode that stimulates ionization of the air. Examples of corona devices are corotrons, scorotrons, discorotrons and pin corotrons. Examples of a coronode are thin wire, pins, and dielectric coated wire.

Figure 5:
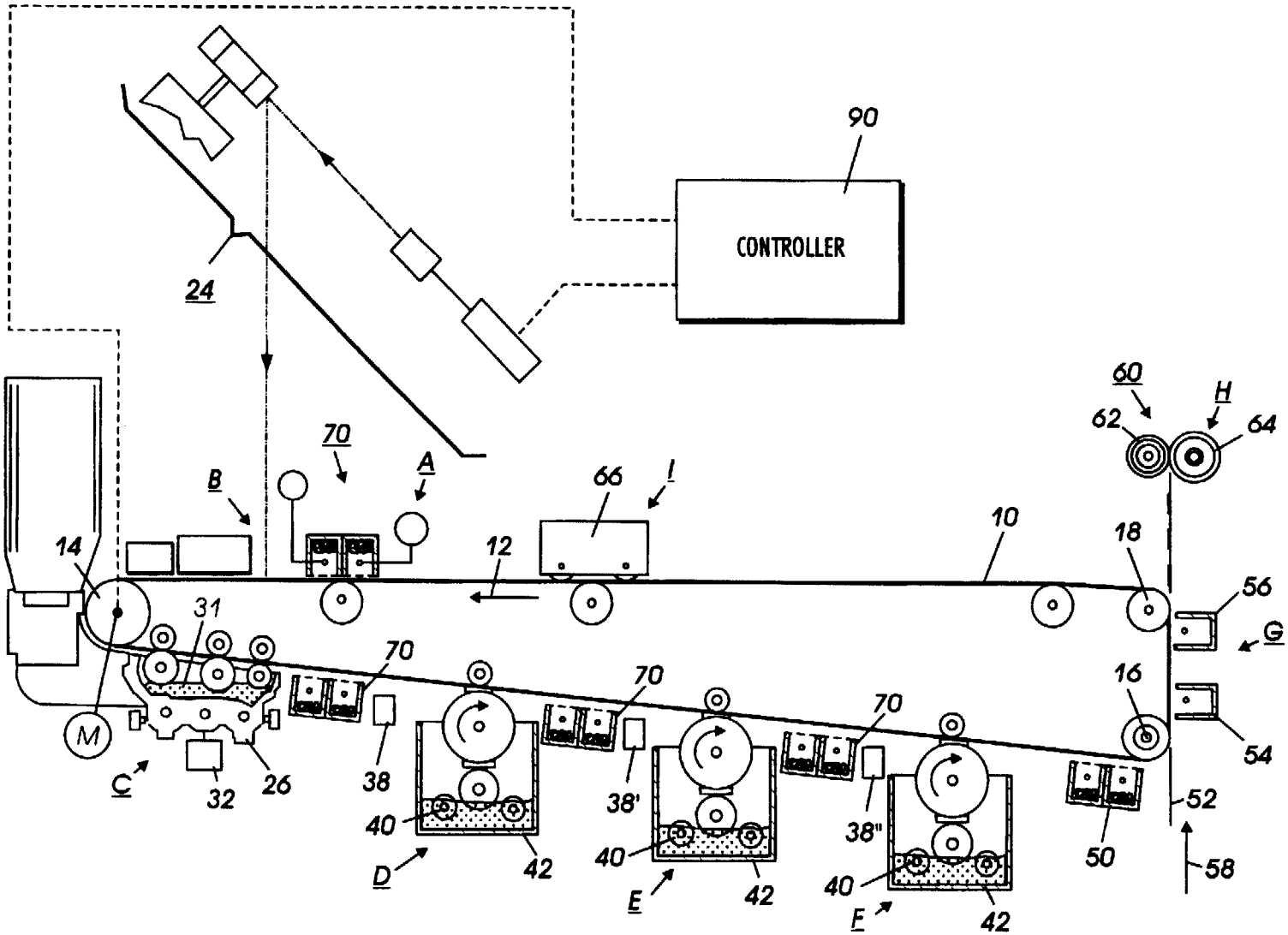
FIG. 5 is a schematic diagram of a four color image output terminal utilizing the discorotron noise reduction apparatus and method of the present invention.

Turning now to FIG. 5, the electrophotographic printing machine of the present invention uses a charge retentive surface in the form of an Active Matrix (AMAT) photoreceptor belt 10 supported for movement in the direction indicated by arrow 12, for advancing sequentially through the various xerographic process stations and controlled by a controller 90. The belt is entrained about a drive roller 14 and two tension rollers 16 and 18 and the roller 14 is operatively connected to a drive motor M for effecting movement of the belt through the xerographic stations.

With continued reference to FIG. 5, a portion of belt 10 passes through charging station A where a corona generating device, indicated generally by the reference numeral 70, charges the photoconductive surface of belt 10 to a relative high, substantially uniform, preferably negative potential.

Next, the charged portion of photoconductive surface is advanced through an imaging station B. At imaging exposure station B, the uniformly charged belt 10 is exposed to a laser based output scanning device 24 which causes the charge retentive surface to be discharged in accordance with the output from the scanning device. Preferably the scanning device is a laser Raster Output Scanner (ROS). Alternatively, the ROS could be replaced by other xerographic exposure devices such as LED arrays.

The photoreceptor, which is initially charged to a voltage $V_O$, undergoes dark decay to a level $V_{ddp}$ equal to about −500 volts. When exposed at the exposure station B it is discharged to $V_{background}$ equal to about −50 volts. Thus after exposure, the photoreceptor contains a monopolar voltage profile of high and low voltages, the former corresponding to charged areas and the latter corresponding to discharged or background areas.

At a first development station C, a magnetic brush developer structure, indicated generally by the reference numeral 26 advances insulative magnetic brush (IMB) material 31 into contact with the electrostatic latent image. The development structure 26 comprises a plurality of magnetic brush roller members. These magnetic brush rollers present, for example, charged black toner material to the image areas for development thereof. Appropriate developer biasing is accomplished via power supply 32.

A corona recharge device 70 having a high output current vs. control surface voltage (I/V) characteristic slope is employed for raising the voltage level of both the toned and untoned areas on the photoreceptor to a uniform predetermined level.

A second exposure or imaging device 38 which may comprise a laser based input and/or output structure is utilized for selectively discharging the photoreceptor on toned areas and/or bare areas, pursuant to the image to be developed with a second color developer. At this point, the photoreceptor contains toned and untoned areas at relatively high voltage levels and toned and untoned areas at relatively low voltage levels. These low voltage areas represent image areas which are developed using discharged area development (DAD). To this end, a negatively charged, developer material 40 comprising color toner is employed. The toner, which by way of example may be yellow, is contained in a developer housing structure 42 disposed at a second developer station D and is presented to the latent images on the photoreceptor by a magnetic brush developer roller. A power supply (not shown) serves to electrically bias the developer structure to a level effective to develop the DAD image areas with negatively charged yellow toner particles 40.

The above procedure is repeated for a third imager for a third suitable color toner such as magenta and for a fourth imager and suitable color toner such as cyan. In this manner a full color composite toner image is developed on the photoreceptor belt.

To the extent to which some toner charge is totally neutralized, or the polarity reversed, thereby causing the composite image developed on the photoreceptor to consist of both positive and negative toner, a negative pretransfer discorotron member 50 is provided to precondition the toner for effective transfer to a substrate using positive corona discharge.

Subsequent to pretransfer a sheet of support material 52 is moved into contact with the toner images at transfer station G. The sheet of support material is advanced to transfer station G by conventional sheet feeding apparatus, not shown. Preferably, the sheet feeding apparatus includes a feed roll contacting the uppermost sheet of a stack of copy sheets. The feed roll rotates so as to advance the uppermost sheet from the stack into a chute which directs the advancing sheet of support material into contact with the photoconductive surface of belt 10 in a timed sequence so that the toner powder image developed thereon contacts the advancing sheet of support material at transfer station G.

Transfer station G includes a transfer dicorotron 54 which sprays positive ions onto the backside of sheet 52. This attracts the negatively charged toner powder images from the belt 10 to sheet 52. A detack dicorotron 56 is provided for facilitating stripping of the sheets from the belt 10.

After transfer, the sheet continues to move, in the direction of arrow 58, onto a conveyor (not shown) which advances the sheet to fusing station H. Fusing station H includes a fuser assembly, indicated generally by the reference numeral 60, which permanently affixes the transferred powder image to sheet 52. Preferably, fuser assembly 60 comprises a heated fuser roller 62 and a backup or pressure roller 64. Sheet 52 passes between fuser roller 62 and backup roller 64 with the toner powder image contacting fuser roller 62. In this manner, the toner powder images are permanently affixed to sheet 52 after it is allowed to cool. After fusing, a chute, not shown, guides the advancing sheets 52 to a catch tray, not shown, for subsequent removal from the printing machine by the operator.

After the sheet of support material is separated from photoconductive surface of belt 10, the residual toner particles carried by the non-image areas on the photoconductive surface are removed therefrom. These particles are removed at cleaning station I using a cleaning brush structure contained in a housing 66.

It is believed that the foregoing description is sufficient for the purposes of the present application to illustrate the general operation of a color printing machine.

Figure 1:
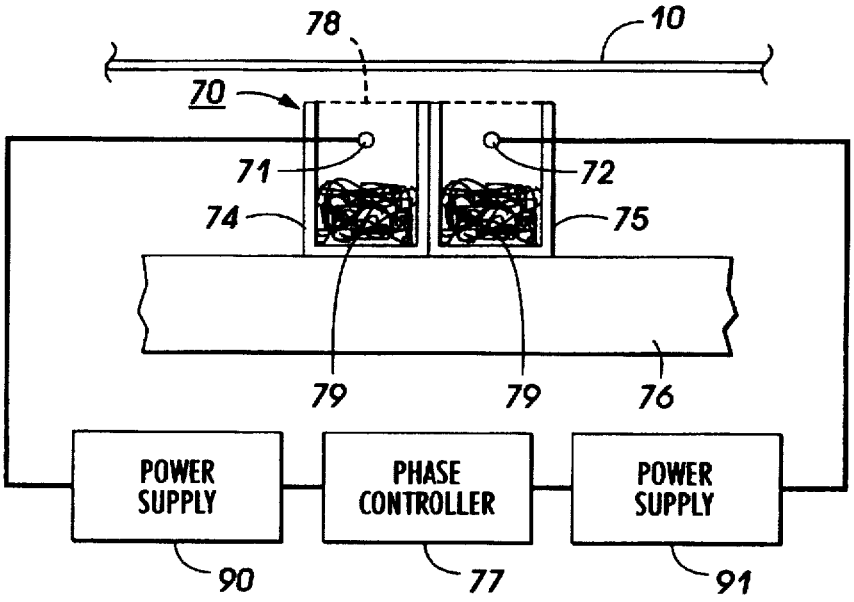
FIG. 1 shows a corona device referred to as a discorotron system in accordance with the present invention employing two corotron wires.
Figure 2:
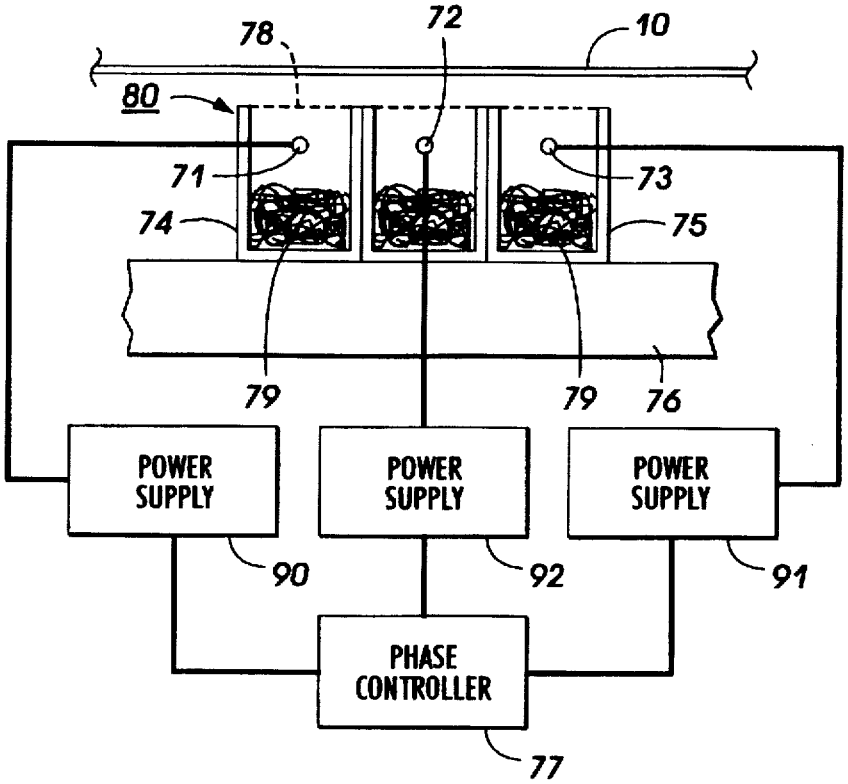
FIG. 2 shows a corona device referred to as a discorotron system in accordance with the present invention employing three corotron wires.

Turning now to FIGS. 1–2 inclusive, there is illustrated configurations of discorotrons useful in the printer apparatus of FIG. 5. In FIG. 1, a discorotron system 70 is shown supported by frame member 76 closely adjacent to photoreceptor belt 10. Discorotron is used herein to mean a dielectric coated coronode wire with a charge leveling screen located at a predetermined distance from the corotron wire. The discorotron system 70 comprises two coronode wires 71 and 72 that are enclosed on opposite sides by walls 74 and 75 and a charge leveling screen 78 that are mounted on a bottom support member positioned on frame 76. Acoustic absorption material 79 is included beneath coronodes 71 and 72 while the corotrons are powered by power supplies 90 and 91, respectively and phase controlled by phase controller 77. One way to control noise of discorotrons is to steer the noise radiated by the discorotron system 70 to a predetermined location. By redistributing the sound field, the unwanted noise can be dissipated inside the machine. For maximum treatment, absorption material 79 can be placed at location(s) where this unwanted noise is directed.

Figure 3:
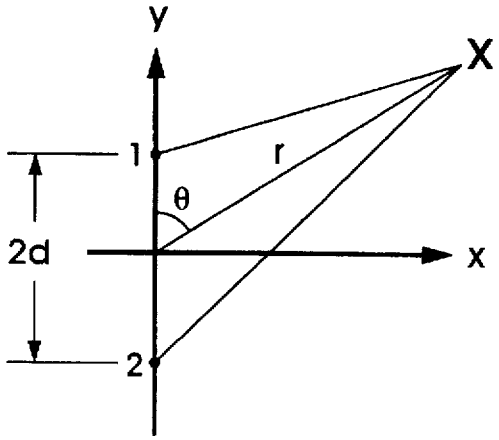
FIG. 3 is a diagram showing two coronodes in space separated by some distance 2d.

Redistribution of noise from discorotron system 70 is accomplished by setting coronodes 71 and 72 at a different phase with phase controller 77, preferably 91° apart for charging frequency set at 4 kHZ. By doing so, minimum noise will be recognized along one direction and maximum noise recognized along another direction. The desired phase difference is a function of the drive frequency and spacing between the wires. This 91° phase difference is confirmed by the calculations that follow:

The sound power of a system (W) is:

$$w=\int pu\ ds \tag{1}$$

where p, u, d and s are the acoustic pressure, particle velocity, half the distance between the two coronodes and surface area enclosing the sound source. Here, $$p=-\rho(\partial\phi/\partial t) \text{ and } u=(\partial\phi/\partial r)$$

where Φ is the velocity potential at a point X due to both coronodes, see FIG. 3.

The velocity potential at point X can be written as:

$$\phi=-\frac{e^{-ikr}}{4\pi r}\{Q_1(t)e^{ikd\cos\theta}+Q_2(t)e^{-ikd\cos\theta}\} \tag{2}$$

Let $$Q_1=Qe^{i(\omega t+\alpha)} \tag{3}$$

$$Q_2=Qe^{i(\omega t-\alpha)} \tag{4}$$

where Q is the source strength, 2α is the phase difference between the two coronodes 1 & 2, ω is the angular frequency, k is the wave number and $i^2=-1$. Derivation for the above expressions (2), (3) and (4) can be found in M. P. Norton's book entitled "Fundamentals of Noise and Vibration Analysis in Engineering", Cambridge, N.Y., 1989, pp 125–132.

Putting (3) and (4) into (2)

$$\phi=-\frac{Qe^{i(\omega t-kr)}}{4\pi r}\{e^{i(kd\cos\theta+\alpha)}+e^{-i(kd\cos\theta+\alpha)}\} \tag{5}$$

or $$\phi=-\frac{Qe^{i(\omega t-kr)}}{2\pi r}\cos(kd\cos\theta+\alpha) \tag{6}$$

For minimum Φ, $\cos(kd\cos\theta+\alpha)=0$, $$kd\cos\theta+\alpha=\pi/2 \tag{7}$$

To design for minimum Φ at θ=0 by adjusting α for a system having, $d=16\times10^{-3}$m, f=8000 Hz, c=340 m/s and $k=2\pi f/c$, $kd=2.365$ $kd\cos\theta+\alpha=\pi/2$ $\alpha=45.5°$, Phase difference=91°

By using a phase difference of 91°, noise of the discorotron has improved from 86 dBA to 80 dBA. An improvement of 6 dBA that corresponds to a 75% improvement.

With the sound field located as such, noise emitted by the discorotron will be reflected back into the discorotron housing by the photoreceptor. Usually this treatment is sufficient to meet the desired purposes, however, under adverse conditions additional attenuation can be achieved by means of noise absorption material 79 placed inside the discorotron housing, as shown in FIG. 1.

While it may appear that discorotron noise control may be achieved by charging two corotron wires 180° out of phase with each other, experiment has shown that the current invention is much more effective. The noise level of a discorotron without treatment is 86 dBA. The current invention with the corotrons set at about 91° out of phase yields a noise level of 80 dBA. The 180° out of phase configuration yields a noise level of 82 dBA. With absorption, the current invention yields 76 dBA and the 180° out of phase yields 78 dBA. Clearly, the result obtained by the present invention is consistently better than that via 180° out of phase. It is 2 dB (40%) better.

Alternate Embodiment/Charge Frequency

Among all known commercially available corotrons, the charging frequency is less than 800 Hz for bare wire systems and 4 kHz only for dielectric wires. In the present invention, it was found that the charging frequency of the system can be optimized inside and outside the specifications of these prior devices so that the maximum noise can be steered into a predetermined location for dissipation. For example, for a coronode system with spacing of $d=1.6\times10^{-2}$ m, the maximum noise can be steered towards the photoreceptor belt 10 of FIG. 1 so that the unwanted noise can be reflected back into the coronode system for dissipation Here, θ=0, cos θ=1 a=0, if no phase adjustment is used.

$d=1.6\times10^{-2}m$

From equation (7)

$kd\cos\theta+\alpha=\pi/2$ $k=\pi/2d$ f=5313 Hz

Experiments have confirmed that the optimum frequency for this system is 4800 Hz. This frequency is about 90% of prediction. Noise is reduced from 86 dBA to 76 dBA. This 10 dBA improvement corresponds to a 90% improvement.

Yet Another Embodiment/Wire Spacing

Figure 4A:
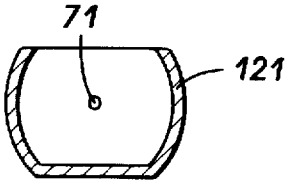
FIGS. 4A, 4B and 4C show single wire corona systems.
Figure 4B:
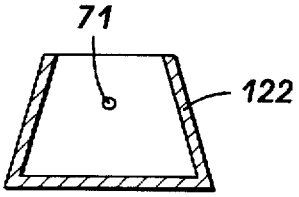

Generally, for corotrons that exist in the market, the spacing (FIG. 4) of the wires is from 10 to 25 mm for bare wire and 30 mm only for dielectric wires. With the present invention, it was found that the spacing of the wires can be optimized so that the maximum noise can be steered into a predetermined location for dissipation. For example, in a coronode system with a charging frequency of 4 kHz, the maximum noise can be steered towards the photoreceptor belt 10 of FIG. 1 so that the unwanted noise can be reflected back into the coronode system for dissipation.

Here,

θ=0, cos θ=1

α=0, if no phase adjustment is used.

$k=2\pi f/c=73.92$

From equation (7)

$kd\cos\theta+\alpha=\pi/2$ $73.92\ d=\pi/2$ $d=2.1\times10^{-2}$ m, or 4.2 cm apart between the two wires Three Wire System A three wire corona system 80 is shown in FIG. 2 that includes a coronode 73 in addition to coronodes 71 and 72 with screen 78. For a three wire system, noise is controlled by charging the two outside coronodes 71 and 73, at the same voltage and the same phase, with power supplies 90 and 91, respectively. The center coronode 72 is charged twice the voltage and 91° out of phase relative to the outside coronodes by power supply 92. Phase difference between 71/73 and 72 is controlled by a phase controller 77. Absorption with material 79 can be used for additional noise abatement, if desired.

Single Wire System

Figure 4C:
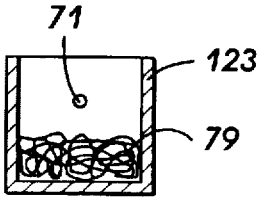

For a single wire corona system, coronode housings in the past have been rectangular in shape. With respect to FIGS. 4A, 4B and 4C, in accordance with the present invention, a means to control the noise of a one wire 71 corona system is to reflect as much noise into the housing as possible. This is accomplished by using a non rectangular housing. An example is concave housing 121 of FIG. 4A or trapezoidal housing 122 of FIG. 4B with the base wider than the opening portion thereof. Yet another embodiment of the present invention that controls noise is shown in FIG. 4C that includes absorption material(s) 79 in areas, such as, the base of rectangular housing 123. It should be understood that absorption material(s) could be used in the housings of FIGS. 4A and 4B for additional noise reduction, if desired.

In recapitulation, a method and apparatus for achieving optimum noise control for corotron usage is disclosed. The noise improvement over conventional corotron systems is realized by steering and redistributing the sound field in space so that the noise can be reflected back towards the corotron and dissipated within the machine. This can be accomplished by optimizing the phase difference between the wires, the charging frequency and/or the spacing between the wires. Another approach is to use absorption and/or to use a non rectangular housing.

It is, therefore, apparent that there has been provided in accordance with the present invention, a method and apparatus for noise reduction of corotron wires in a copier/printer that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. A method of achieving optimum noise control in a charging system of a copier/printer, comprising:

providing multiple coronodes;

providing a housing for supporting said multiple coronodes spaced from each other;

providing means for charging said multiple coronodes;

charging said multiple corotrons at a different phase angle such that minimum noise will be recognized along one direction and maximum noise will be recognized along another direction, and determining said different phase angle as a function of drive frequency and spacing between said coronodes.

2. The method according to claim 1, further comprising placing an absorption material in said housing.

3. The method according to claim 2, further comprising placing said absorption material beneath said multiple coronodes in order to increase noise control.

4. The method according to claim 1, further comprising:

providing a conductive screen in cooperation with said housing and positioned closely spaced from said multiple coronodes.

5. The method according to claim 1, further comprising the step of charging said multiple coronodes at a phase angle of about 91°.

6. An electrophotographic printing machine with optimum noise control capacity, comprising:

an image carrying media;

at least one unit of at least two coronodes for charging said image carrying media;

a power source; and a phase controller for controlling the charging of each of said at least two coronodes at a different phase in order to attenuate noise from said coronodes.

7. The printing machine according to claim 6, further comprising noise absorption material added to said at least one unit of at least two coronodes.

8. The printing machine according to claim 6, wherein said phase difference is about 91°.

9. The printing machine according to claim 8, wherein said phase difference is determined by a function of drive frequency and spacing between said coronodes.

10. A noise controlled charging system, comprising:

at least two coronodes;

a housing with at least two coronodes spaced from each other;

a power supply for energizing each of said at least two coronodes; and a phase control connected to said power supply and adapted to control energizing of said at least two coronodes such that each of said at least two coronodes is charged at a phase difference.

11. The charging system according to claim 10, further comprising noise absorption material added to said housing.

12. The charging system according to claim 10, wherein said phase difference is more than 0°.

13. The charging system according to claim 12, wherein said phase difference is determined by a function of drive frequency and spacing between said coronodes.

14. The charging system according to claim 10, wherein said at least two coronodes are bare wires, and wherein said bare wires are charged at a frequency of more than 800 Hz.

15. The charging system according to claim 10, wherein said at least two coronodes are coated wires, and wherein said coated wires are charged at a frequency of more than 0 Hz.

16. The charging system according to claim 10, wherein spacing between said at least two coronodes is more than 25 mm.

17. The charging system according to claim 10, wherein spacing between said at least two coronodes is less than 10 mm.

18. The charging system according to claim 10, wherein said at least two coronodes are dielectric, and wherein the spacing between said at least two coronodes is at least 4 mm.

19. A noise controlled charging system, comprising:

a coronode;

a housing having a base and walls extending orthogonally therefrom and an opening therein between said walls, said coronode being positioned within said housing and adapted when energized to emit ions through said opening in said housing;

a power supply for energizing said coronode, and a sound absorption material positioned within said housing.

20. The noise controlled charging system of claim 19, wherein said sound absorption material is positioned atop said base of said housing.

21. The noise controlled charging system of claim 19, including multiple housings with a coronode in each housing.

22. The noise controlled charging system of claim 19, wherein said housing includes a base and upstanding orthogonal walls extending therefrom.

* * * * *